United States Patent [19]

Mrenna et al.

[11] Patent Number: 4,933,653

[45] Date of Patent: Jun. 12, 1990

[54] CIRCUIT BREAKER WITH LOW CURRENT MAGNETIC TRIP

[75] Inventors: Stephen A. Mrenna; Melvin A. Carrodus, both of Brighton Twp., Beaver County; Kurt A. Grunert, Beaver; Jere L. McKee, Scott Twp., Lawrence County, all of Pa.

[73] Assignee: Westinghouse Electric Corp., Pittsburgh, Pa.

[21] Appl. No.: 412,240

[22] Filed: Sep. 25, 1989

[51] Int. Cl.[5] ..... H01H 75/12

[52] U.S. Cl. ..... 335/37; 335/174

[58] Field of Search ..... 335/37–41, 335/42–45, 174, 175

[56] References Cited

U.S. PATENT DOCUMENTS

| | | | |
|---|---|---|---|
| 3,081,386 | 3/1963 | Koenig et al. | 335/37 |
| 3,156,796 | 11/1964 | Vogelsberg | 335/38 |
| 3,214,335 | 10/1965 | Koenig et al. | 335/37 |
| 3,950,715 | 4/1976 | Bagalini et al. | 335/37 |
| 4,081,852 | 3/1978 | Coley et al. | 335/37 |

*Primary Examiner*—Leo P. Picard
*Assistant Examiner*—Lincoln Donovan
*Attorney, Agent, or Firm*—M. J. Moran

[57] ABSTRACT

A circuit breaker having a trip mechanism comprising a primary armature which is attracted toward a bimetal by magnetic flux produced by a predetermined overcurrent flowing through the bimetal to unlatch an operating mechanism and open electrical contacts, includes a pivoted supplemental armature which is also attracted toward the bimetal by the overcurrent and which bears against and urges the primary armature toward the bimetal to thereby reduce the predetermined overcurrent at which the breaker opens the electrical contacts. The supplemental armature comprises a flat strip of magnetically permeable material which is bent at one end to form a hook which merely drops into a recess in the breaker housing. Integral flanges on the strip form a magnetic yoke which concentrates the magnetic flux to increase the sensitivity of the magnetic trip function.

11 Claims, 3 Drawing Sheets

CIRCUIT BREAKER WITH LOW CURRENT MAGNETIC TRIP

BACKGROUND OF THE INVENTION

1. Field of the Invention

This invention relates to circuit breakers having a magnetic trip assembly in which the magnetic field induced by an abnormal current unlatches a latchable operating mechanism to trip the breaker, and more particularly to such a magnetic trip assembly which is responsive to low levels of overcurrent.

2. Background Information

A common type of circuit breaker used to automatically interrupt abnormal currents in an electrical system incorporates a thermal trip device which responds to persistent low levels of overcurrent and a magnetic trip assembly which responds instantly to higher levels of overcurrent. An example of such a circuit breaker is disclosed in U.S. Pat. No. 3,849,747. In such circuit breakers, the thermal trip device comprises a bimetal which bends in response to the persistent low level overcurrent passed through it to unlatch a latchable operating mechanism. The latchable operating mechanism is spring operated to open electrical contacts which interrupt the current. The magnetic trip assembly includes an armature which is spring biased to latch the operating mechanism. The current through the bimetal produces a magnetic field which is concentrated by a magnetic yoke to attract the armature and unlatch the operating mechanism at a specified level of overcurrent. The bimetal in these circuit breakers acts as a one turn electromagnet for the magnetic trip assembly.

Such circuit breakers have been in use for many years and their design has been refined to provide an effective, reliable circuit breaker which can be easily and economically manufactured on a large scale.

Recently there has developed a market for such circuit breakers with a magnetic trip assembly which operates at lower levels of instantaneous overcurrent. The level of overcurrent at which the magnetic trip operates is a function of several factors, including the friction force applied by the spring operated latchable operating mechanism to the armature of the magnetic trip assembly, the spring constant of the spring biasing the armature to latch the operating mechanism, the magnitude of the magnetic field produce by the overcurrent and the coupling of the magnetic field to the armature. One approach to lowering the level of overcurrent at which the magnetic trip operates is to loop a wire providing current to the bimetal around the magnetic yoke to increase the ampere turns of the electromagnet, and therefore, the strength of the field. However, such an approach adds complexity to the circuit breaker mechanism thereby adding steps and cost to the manufacturing process.

There remains a need, therefore, for an improved circuit breaker with a low magnetic trip.

There is a further need for such a circuit breaker which can be produced economically.

There is a related need for a circuit breaker with a low magnetic trip which requires little modification to the existing circuit breaker designs.

SUMMARY OF THE INVENTION

These and other needs are satisfied by the invention which is directed to a circuit breaker having a magnetic trip assembly including a primary armature which latches a latchable operating mechanism to maintain electrical contacts in the circuit breaker closed. The primary armature is attracted toward a conductive member in the form of a bimetal in the preferred embodiment of the invention, by a magnetic field produced by an abnormal current through the conductive number to unlatch the latchable operating mechanism and thereby trip the electrical contacts open. The circuit breaker of the invention includes a supplemental armature also attracted toward the conductive member by the magnetic field produced by the abnormal current in the conductive member. The supplemental armature is coupled to and urges the primary armature toward the conductive member to unlatch the latchable operating mechanism at a lower abnormal current than required to unlatch the latchable operating mechanism with the primary armature alone.

The supplemental armature is preferably made of a flat, magnetically permeable strip with integral flanges bent toward the conductive member along at least a portion of the side edges of the strip to concentrate the magnetic flux passing through the supplemental armature thereby increasing the magnetic force attracting the supplemental armature toward the conductive member.

Also preferably, the primary armature is pivoted adjacent one end of the conductive member with a free end extending toward the supplemental armature which is pivoted adjacent the other end of the conductive member. The free end of the supplemental armature overlaps the free end of the primary armature which is between the supplemental armature and the conductive member. A stop limits pivotal movement of the supplemental armature away from the conductive member so that the supplemental armature remains in the magnetic field produced by the current through the conductive member without any positive connections, and preferably the end of the magnetically permeable strip is bent into a hook which is received in a slot in the molded housing of the circuit breaker so that the supplemental armature can just be dropped into position in an existing circuit breaker without any other modifications to the breaker, and without the need for any physical connections. When a predetermined abnormal current flows through the conductive member, the supplemental armature pivots toward the conductive member and pushes the primary armature which is also attracted toward the conductive member, thereby increasing the force unlatching the operating mechanism produced by a given current.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
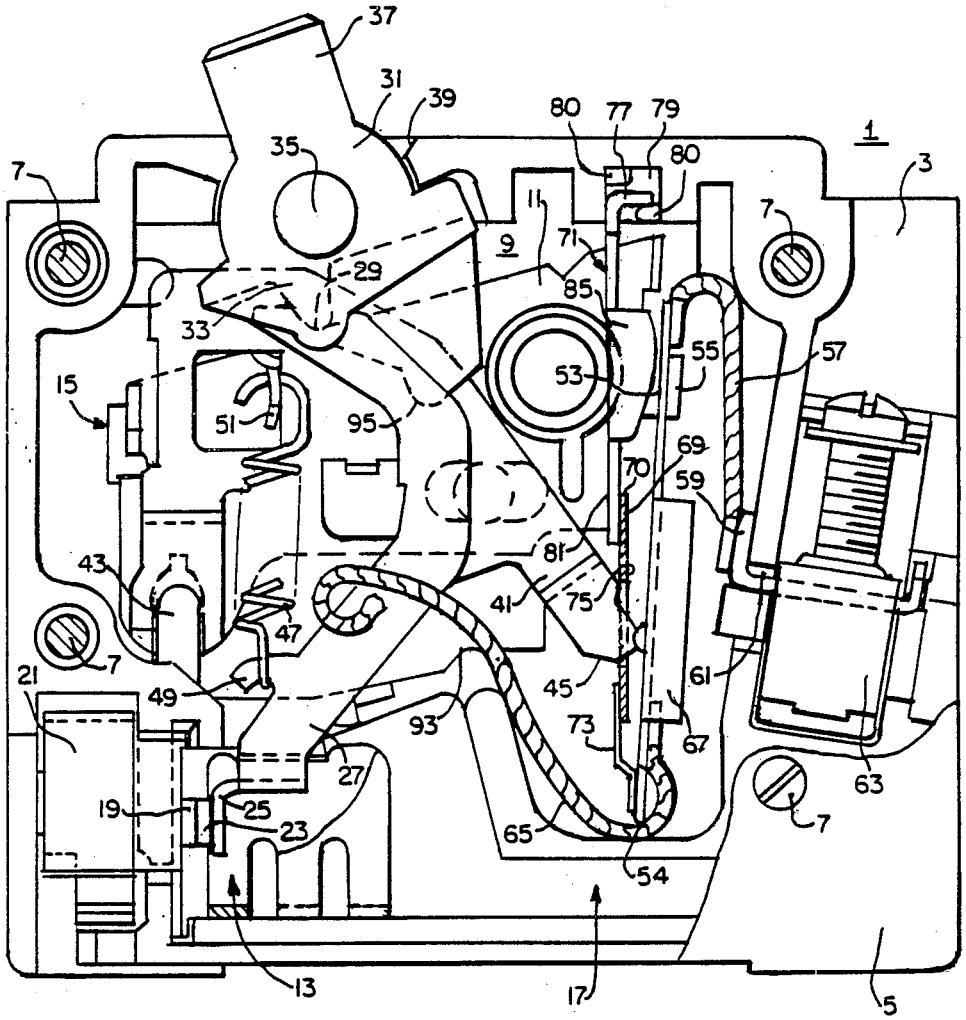
FIG. 1 is a side view of a circuit breaker in accordance with the invention shown in the closed position and with most of the side cover broken away.

As shown in the drawings, the circuit breaker 1 of the invention comprises an insulating housing having a molded insulating compartment part 3 and a molded insulating side cover part 5 secured together by means of four rivots 7. A circuit breaker assembly, indicated generally at 9, is supported in the housing 3, 5. The circuit breaker assembly 9 includes a stationary supporting frame 11 mounted in the housing 3, a set of electrical contacts 13, a latchable operating mechanism 15 and a trip assembly 17. The set of electrical contacts 13 includes a stationary contact 19 secured to a plug-in type line terminal 21 and a moveable contact 23 secured to a small flange 25 on one end of a flat metallic generally C-shaped contact arm or switch arm 27 which forms part of the latchable operating mechanism 15. The contact arm 27 is provided at the upper end with a depression 29. A molded insulating operating member 31 has a molded part 33 which engages the depression 29 in the contact arm 27 to provide a driving connection between the operating member 31 and the contact arm 27. The operating member 31 is molded with a pair of pins 35 extending outwardly on opposite sides (only one shown) which fit into bearing openings (not shown) in the housing 3, 5 to support the operating member 31 for pivoted movement. The operating member 31 includes a handle part 37 which extends through an opening 39 on top of the housing compartment 3 to enable manual operation of the circuit breaker 1.

The latchable operating mechanism 15 also includes a cradle 41 supported at one end for pivoted movement on a molded post part 43 of the insulating housing compartment 3. The other end of the cradle 41 has a latch ledge 45 which is latched by the trip assembly 17 which will be described in detail. An over center tension spring 47 is connected, under tension, at one end to a projection 49 near the lower end of the contact arm 27 and at the upper end thereof to a bent-over projection 51 on the cradle 41.

The trip assembly 17 comprises an elongated bimetal member 53 secured, in proximity to its upper end, to a bent-over tab part 55 on the frame 11. A flexible conductor 57 is secured at one end to the upper end of the bimetal member 53 and at the other end to a conductor 59 that extends through an opening 61 in the housing compartment 3 and is part of a solderless terminal connector 63 that is external accessible and supported in the housing 3 in a well known manner. Another flexible conductor 65 is secured at one end to the free lower end 54 of the bimetal member 53 and at the other end thereof to the contact arm 27 to electrically connect the contact arm 27 with the bimetal member 53.

The electrical circuit through the circuit breaker 1 extends from the line terminal 21, through the stationary contact 19, the moveable contact 23, the contact arm 27, the flexible conductor 65, the bimetal member 53, the flexible conductor 57, the conductor 59, to a conducting line (not shown) that would be connected to the conductor 59 by means of the solderless terminal connector 63.

The circuit breaker 1 may be manually operated to open and close the set of electrical contacts 13 by operation of the operating member 31 through the handle portion 37. Movement of the operating member 31 clockwise from the closed or "on" position (FIG. 1) to the open or "off" position (FIG. 2) carries the upper end of the contact arm 27 to the left of the line of action of the spring 47 whereupon the spring 47 acts to move the contact arm 27 with a snap action to the open position (FIG. 2). Movement of the operating handle 37 in a counterclockwise direction back to the closed position moves the upper end of the moveable contact arm 27 to the right of the line of action of the spring 47 whereupon the spring acts to return the contact arm 27 to the closed position (FIG. 1.) with a snap action.

The trip assembly 17 includes a thermal trip capability which responds to persistent low level overcurrents, and a magnetic trip capability which responds instantaneously to higher overload currents, as in prior art circuit breakers. The present invention provides improved sensitivity of the magnetic trip function, and thus provides the capability of an instantaneous trip at lower values of overload current than comparable presently available circuit breakers. The trip assembly 17 includes the bimetal member 53, a magnetic yoke 67, a primary magnetic armature 69, and a secondary magnetic armature 71. The magnetic yoke 67 is a generally U-shaped member secured to the bimetal member 53 at the bight portion of the magnetic yoke 67 with the legs thereof facing the primary armature 69, as is known. The primary magnetic armature 69 is secured to a supporting spring 73 that is secured, at its lower end, near the free end 54 of cantilevered bimetal member 53. Thus, the primary armature 69 is supported on the bimetal member 53 by the spring 73. The primary armature 69 has a window opening 75 through which the one end of the cradle 41 extends with the latch ledge 45 on the cradle engaging the edge of the window 75 to latch the latchable operating mechanism 15 in the latched position shown in FIGS. 1 and 2.

Figure 2:
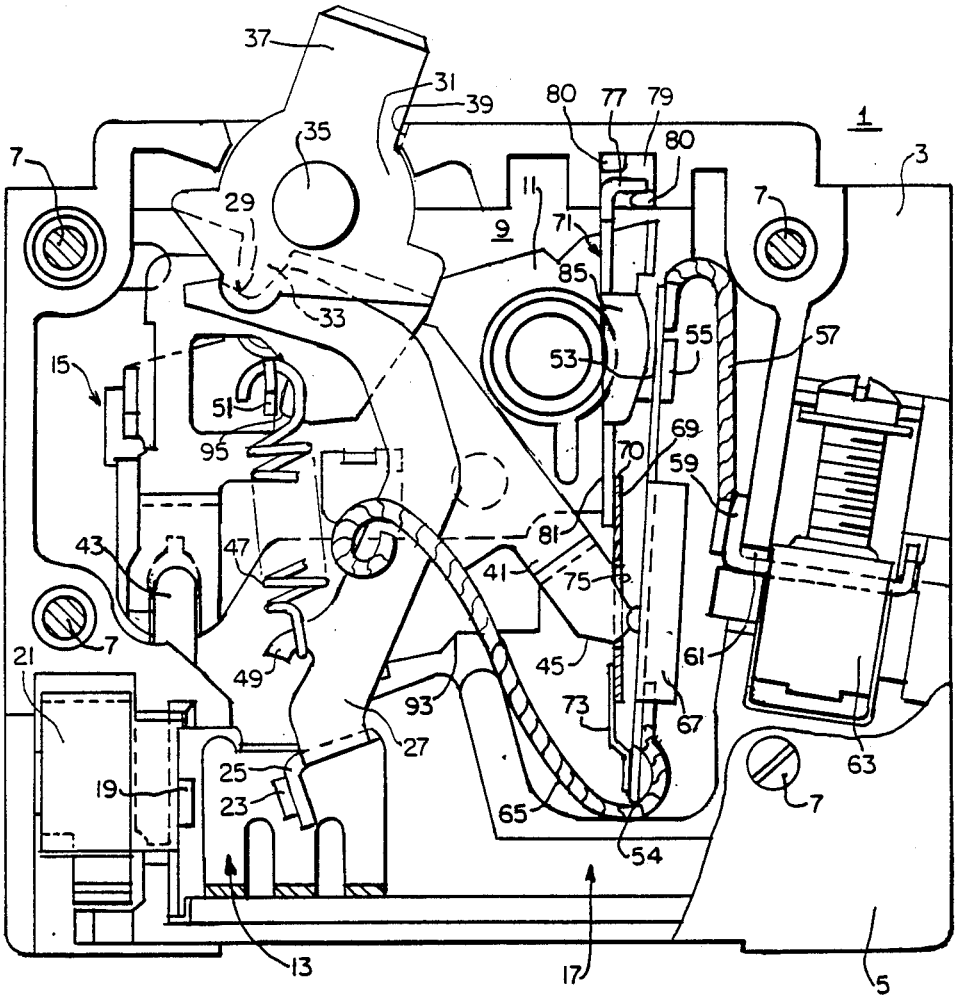
FIG. 2 is a view similar to that of FIG. 1 showing the circuit breaker in the open position.
Figure 3:
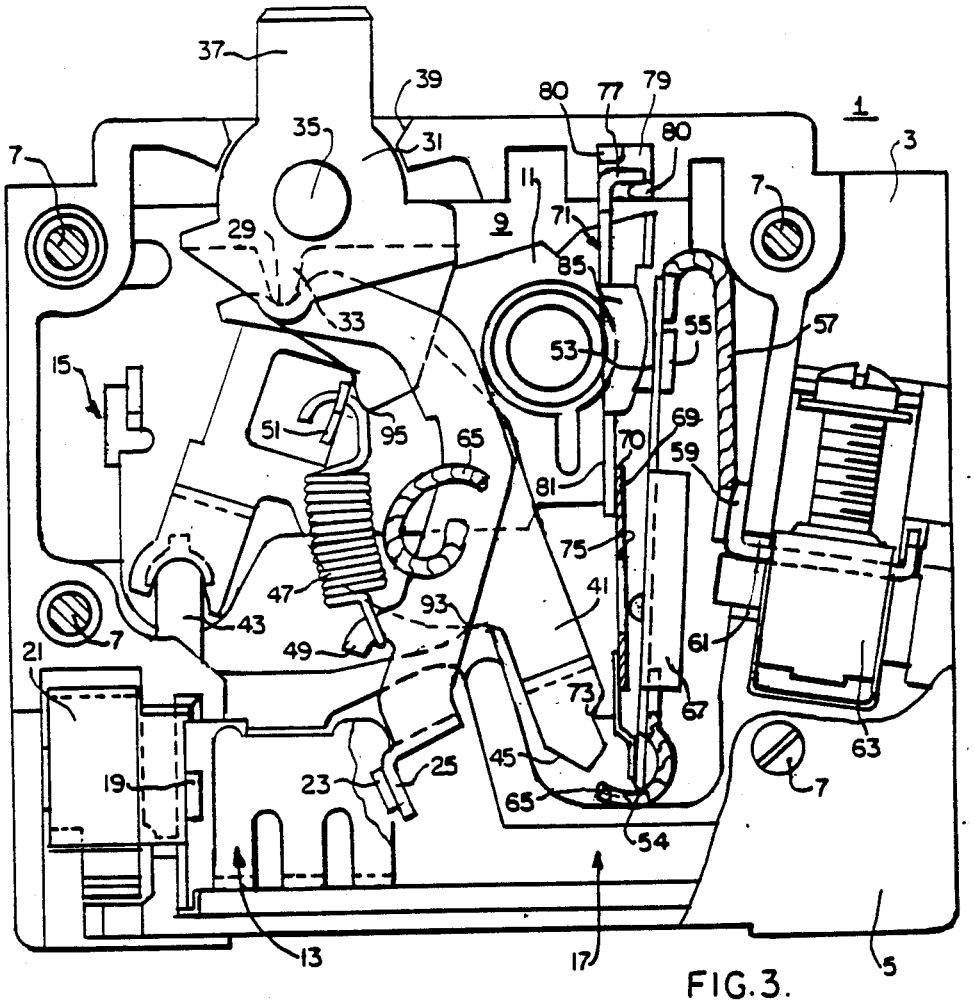
FIG. 3 is a view similar to that of FIG. 1 showing the circuit breaker in the tripped position.
Figure 4:
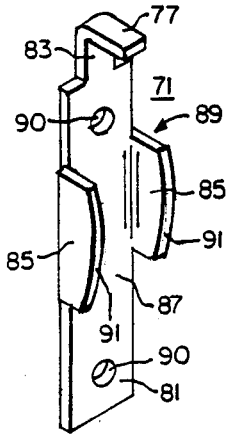
FIG. 4 is a isometric view of a supplemental armature which forms part of the circuit breaker of FIGS. 1 through 3.

The supplemental armature 71 is an elongated member having a hook 77 at the upper end thereof which is received in the recess 79 molded in the housing 3 to pivotally mount the supplemental armature adjacent the upper end of the bimetal member 53. The free end 81 of the supplemental magnetic armature 71 overlaps the upper end 70 of the primary armature 69 with the primary armature 69 between the bimetal member 53 and the lower end 81 of the supplemental armature 71. As best seen in FIG. 4, the secondary magnetic armature 71 is made from a flat strip of magnetically permeable material. The hook 77 is formed by a 90 degree bend in a narrow projection 83 at the upper end of the strip. Integral flanges 85 extending generally perpendicular to the flat main body 87 of the supplemental armature 71 form with the main body 87 a magnetic yoke 89. As in the case of the primary armature 69, the magnetic yoke 89 concentrates magnetic flux produced by current flowing through the bimetal member 53 to develop a force which attracts the supplemental armature toward the bimetal member 53. The edges 91 of the flanges 85 are curved to accommodate for the rotation of the supplemental armature toward the bimetal member 53. Apertures 90 through the main body 87 are used to hold the supplemental armature 71 during manufacture and are not necessary to its operation. Projections 80 defining the recess 79 in the housing compartment 3 which receives the hook 77, form a stop which limits rotation of the supplemental armature 71 in a clockwise direction away from the bimetal member 53 so that supplemental armature remains at all times within the magnetic field generated by current through bimetal member 53. The supplemental armature 71 is merely dropped into the housing 3 with the hook 77 in engagement with the recess 79, and with the free end 81 thereof to the left as viewed in FIGS. 1 through 3 of the upper end of the primary armature 69. Thus, the supplemental armature 71 may be added to the existing circuit breakers with minimal effort.

When the overload current reaches a first predetermined value, the bimetal member 53 become heated and deflects to the right as viewed in FIG. 1 to effect a time delayed thermal tripping operation. The primary armature 69, which is supported on the bimetal member 53 by means of the leaf spring 73, is carried to the right with the bimetal member 53 to release the cradle 41. When the cradle 41 is released, the spring 47 rotates the cradle clockwise on the post 43 until this motion is arrested by the engagement of the cradle 41 with a molded part 93 of the housing compartment 3. During this movement, the spring 47 also moves the contact arm 27 to open the set of electrical contacts 13, and the operating member 31 to position the handle 37 to a position intermediately "on" and "off" positions to provide a visual indication that the circuit breaker 1 has tripped open. The tripped position of the parts is shown in FIG. 3.

Before the contacts can be closed following an automatic tripping operation, it is necessary to reset the latchable operating mechanism 15. This is accomplished by moving the handle 37 of the operating member 31 clockwise from the intermediate position of FIG. 3 to a position slightly beyond the full open or "off" position. During this movement, due to the engagement of a downwardly extending portion 95 of the operating member 31 with the bent-over extension 51 of the cradle (see FIG. 3), the cradle 41 is moved counterclockwise about the post 43 until the latch ledge 45 on the cradle is again latched in the window opening 75 of the primary armature 69 (as shown in FIG. 2). Following the resetting operation, the handle 37 can be moved to the on position to close the electrical contacts 13 as described above.

The circuit breaker 1 is magnetically tripped automatically and instantaneously in response to overload currents above a second predetermined value higher than the first predetermined value. As a result of the invention, this second predetermined value, while being higher than the first predetermined value which causes the thermal trip, is lower than the value of overcurrent required to produce a magnetic trip in the prior art circuit breakers of comparable design. Flow of overload current above the second predetermined value through the bimetal member 53 induces magnetic flux around the bimetal. A portion of this magnetic flux is concentrated by the magnetic yoke 67 toward the primary armature 69. Another portion of the magnetic flux generated by current flowing through the bimetal member 53 is concentrated by the magnetic yoke 89 which is an integral part of the supplement armature 71. When an overload current above the second predetermined value occurs, the force produced by the magnetic flux is of such a strength that the primary armature 69 is attracted toward magnetic yoke 67 resulting in flexing of the spring 73 permitting the primary armature 69 to move to the right to release the cradle 41 and trip the circuit breaker open in the same manner as described with regard the thermal tripping operation. The overcurrent at which this occurs is reduced by the supplemental armature 71 which is also attracted toward the bimetal by the magnetic force generated by an overcurrent above the second predetermined value. As the supplemental armature 71 moves to the right, its lower end 81 bears against the primary armature 69 and assists, the primary armature in overcoming the friction forces generated by the latching engagement of the cradle with the window of the primary armature and the resistance of the mounting spring 73. Following a magnetic tripping operation, the circuit breaker is reset and relatched in the same manner as described above.

As has been disclosed, the present invention provides a circuit breaker with a magnetic trip function which operates at lower instantaneous overload currents than those at which prior art circuit breakers of comparable design could operate. This function is provided by a simple supplemental armature which can be fabricated from a single piece of flat magnetically permeable material and is merely dropped into place in the existing circuit breaker without need for other modification to the circuit breaker and without additional manufacturing steps.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker for responding to abnormal currents in an electrical conductor, said circuit breaker comprising:

electrical contacts operable between a closed position in which a circuit is completed through the electrical conductor and an open position in which the circuit through the electrical conductor is interrupted;

a latchable operating mechanism operable to open said electrical contacts when unlatched; and a magnetic trip assembly comprising:

a conductive member through which the current from said conductor flows to produce a magnetic flux;

a primary armature which in a latch position latches said latchable operating mechanism and which is attracted toward said conductive member to unlatch said latchable operating mechanism by the magnetic flux produced by abnormal current in said conductive member;

biasing means biasing said primary armature away from said conductive member to said latching position; and a supplemental armature which also is attracted toward said conductive member by the magnetic flux produced by an abnormal current in said conductive member, and which bears against and urges said primary armature toward said conductive member to unlatch said latchable operating mechanism at a lower abnormal current than required to unlatch the latchable operating mechanism with the primary armature alone.

2. The circuit breaker of claim 1 wherein said primary armature is pivoted adjacent one end of said conductive member and has a free end extending toward the other end of the conductive member, and wherein said supplemental armature is pivoted adjacent the other end of the conductive member and has a free end extending toward said one end of the conductive member, said free end of the supplemental armature overlapping the free end of the primary armature with the free end of the primary armature between the free end of the supplemental armature and the conductive member.

3. The circuit breaker of claim 2 wherein said supplemental armature has an integral hook member by which supplemental armature is pivoted adjacent said other end of the conductive member and wherein said circuit breaker includes a housing in which said electric contacts, latchable operating mechanism and magnetic trip assembly are housed, said housing including a recess which is pivotally engaged by said hook on said supplemental armature.

4. The circuit breaker of claim 3 including stop means limiting pivoting of said supplemental armature away from said primary armature to a distance at which said supplemental armature remains attracted toward said elongated conductive member by the magnetic flux produced by said current.

5. The circuit breaker of claim 2 wherein said elongated conductive member is a bimetal cantilevered from said other end thereof, and wherein said bias mean comprises a leaf spring pivotally connecting said primary armature to the one end of said bimetal, said bimetal bending in response to persistent current through said conductor above a preset level to move said primary armature from said latch position to unlatch said latchable operating mechanism.

6. The circuit breaker of claim 5 including a magnetic yoke partially surrounding said bimetal adjacent the primary armature to concentrate the magnetic flux in the direction of the primary armature and a second magnetic yoke concentrating said magnetic flux attracting said supplemental armature toward said bimetal.

7. The circuit breaker of claim 1 including means concentrating the magnetic flux produced by current in said conductive member adjacent said supplemental armature to increase the magnetic force attracting the supplemental armature toward the conductive member for a given current through the conductive member.

8. The circuit breaker of claim 7 wherein said means concentrating said magnetic field adjacent the supplemental armature comprises flanges on said supplemental armature extending toward said conductive member.

9. A circuit breaker for responding to abnormal currents in an electrical conductor, said circuit breaker comprising:

electrical contacts operable between a closed position in which a circuit is completed through the electrical conductor and an open position in which the circuit through the electrical conductor is interrupted;

a latchable operating mechanism operable to open said electrical contacts when unlatched; and a magnetic trip assembly comprising:

a bimetal member through which current from said conductor flows to generate a magnetic flux, said bimetal having a free end and being cantilevered from the other end;

a leaf spring connected to said free end of said bimetal;

a primary armature mounted by said leaf spring to extend generally along said bimetal with a free end of said primary armature extending generally toward said other end of the bimetal, said leaf spring biasing said primary armature to latch said latchable operating mechanism and said primary armature being attracted toward said bimetal to unlatch said latchable operating mechanism by said magnetic flux produced by an abnormal current; and a supplemental armature pivoted at one end thereof adjacent said other end of said bimetal and having a free end extending toward and overlapping said free end of the primary armature with the free end of the primary armature between the free end of the supplemental armature and the conductive member, said supplemental armature also being attracted toward said bimetal by the magnetic flux produced by an abnormal current in the bimetal and bearing against and urging said primary armature toward said bimetal to unlatch said latchable operating mechanism at a lower abnormal current than required to unlatch the latchable operating mechanism with the primary armature alone.

10. The circuit breaker of claim 10 wherein said supplemental armature comprises a flat member having said one end bent to form a hook which is received in a recess formed in a housing in which said electrical contacts, said latchable operating mechanism, and said trip assembly are mounted.

11. The circuit breaker of claim 11 wherein said elongated flat member forming said supplemental armature has a pair of integral flanges extending from side edges toward said bimetal to form a magnetic yoke which concentrates said magnetic flux to increase the attraction of said supplemental armature toward said bimetal for a given overcurrent.

* * * * *